United States Patent [19]

Grime

[11] 4,388,997

[45] Jun. 21, 1983

[54] VENT FOR PAINT CUPS

[75] Inventor: Thomas E. Grime, Temperance, Mich.

[73] Assignee: Champion Spark Plug Company, Toledo, Ohio

[21] Appl. No.: 255,358

[22] Filed: Apr. 20, 1981

[51] Int. Cl.[3] ..... B65D 51/16

[52] U.S. Cl. ..... 220/209; 220/367

[58] Field of Search ..... 220/209, 367, 373; 222/464, 193, 181; 239/318, 354; 137/588, 614

[56] References Cited

U.S. PATENT DOCUMENTS

| | | | |
|---|---|---|---|
| 532,878 | 1/1895 | Holmes . | |
| 1,207,274 | 12/1916 | Carter . | |
| 1,477,261 | 12/1923 | Hart . | |
| 1,911,367 | 5/1933 | Kitto . | |
| 2,051,518 | 8/1936 | Cunningham | 299/88 |
| 2,057,434 | 10/1936 | Jaden et al. | 284/17 |
| 2,263,842 | 11/1941 | Gross . | |
| 2,263,843 | 11/1941 | Gross . | |
| 2,298,938 | 10/1942 | Griffin, Jr. et al. . | |
| 2,303,458 | 12/1942 | Hermann et al. | 91/45 |
| 2,424,151 | 7/1947 | Clark et al. | 222/464 |
| 2,571,893 | 10/1951 | Kendall | 220/209 X |
| 2,670,882 | 3/1954 | Best | 222/464 |
| 2,869,188 | 1/1959 | Cameto | 21/117 |
| 2,887,124 | 5/1959 | Mehl | 137/614 |
| 3,157,360 | 11/1964 | Heard | 239/354 |
| 3,198,438 | 8/1965 | Hultgren | 239/318 |
| 3,204,875 | 9/1965 | Langstroth | 239/318 |
| 3,240,398 | 3/1966 | Dalton, Jr. | 222/193 |
| 3,255,972 | 6/1966 | Hultgren et al. | 239/318 |
| 3,401,842 | 9/1968 | Morrison | 222/181 |
| 3,593,921 | 7/1971 | Boltic | 239/318 |
| 3,714,967 | 2/1973 | Zupan et al. | 239/318 |
| 3,797,747 | 3/1974 | Buzzi et al. | 239/311 |
| 3,861,557 | 1/1975 | Tupper | 220/373 |
| 3,942,680 | 3/1976 | Seeley et al. | 220/324 |
| 3,990,609 | 11/1976 | Grant | 222/111 |
| 4,136,796 | 1/1979 | Dubois et al. | 220/256 |
| 4,165,816 | 8/1979 | Tupper | 220/203 |
| 4,307,820 | 12/1981 | Binoche | 220/367 X |

FOREIGN PATENT DOCUMENTS

| | | | |
|---|---|---|---|
| 662889 | 12/1951 | United Kingdom | 220/209 |

*Primary Examiner*—George T. Hall

*Attorney, Agent, or Firm*—Emch, Schaffer & Schaub Co.

[57] ABSTRACT

An improved paint cup for a suction feed hand held spray gun having a jar and a removable cap. A resilient unitary molded check valve either is positioned within or is positioned to cover a vent opening extending through the cap to allow exterior air to flow into the jar while inhibiting paint flow from the jar through the vent opening when the spray gun is tilted.

7 Claims, 9 Drawing Figures

FIG. 7
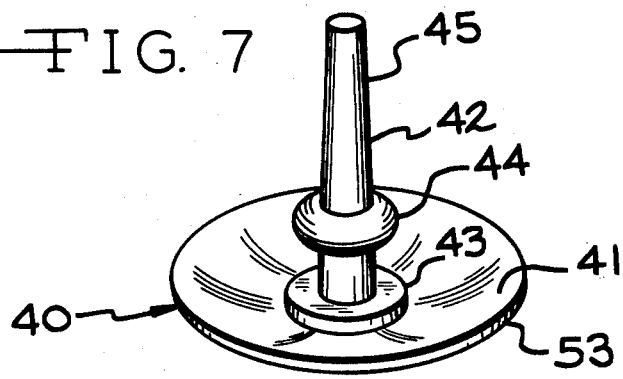
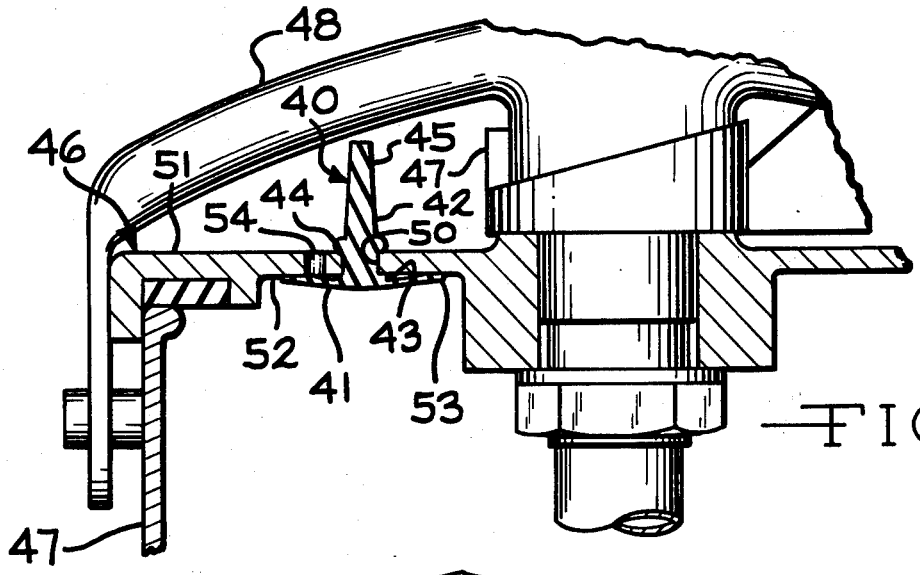
FIG. 8
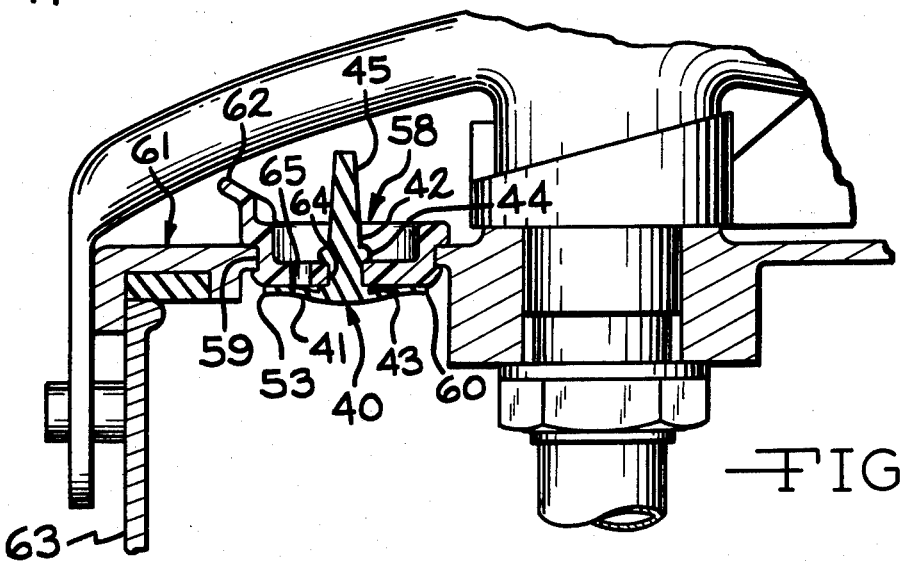
FIG. 9

VENT FOR PAINT CUPS

BACKGROUND OF THE INVENTION

This invention relates to spray painting and more particularly to an improved vent for paint cups of the type mounted on hand held spray guns.

In one common type of hand held spray gun, paint is placed in a cup or reservoir suspended below the spray gun. The hand held spray gun is connected through a hose to a source of compressed air. When a trigger on the spray gun is squeezed, air flow through the spray gun causes a suction feed or aspiration of paint from a jar or cup into the air stream. The air stream then atomizes and discharges the paint from the gun. As paint is drawn from the cup, air must be allowed to flow into the cup to fill the space previously occupied by the paint. If air is not allowed to enter the cup, a vacuum will build up within the cup as paint is consumed until the vacuum equals the force of the suction feed, at which time no further paint will flow to the spray gun. Consequently, it is necessary to vent the cup to the atmosphere.

In the simplest type of hand held spray gun, the vent merely comprises a hole or opening in the lid or cap of the paint cup. This construction is satisfactory, provided the spray gun is not tilted during operation to a position where the vent is located below the paint surface, thereby allowing the paint to drip through the vent hole. One solution to this problem has been to provide a long, small diameter tube or passage in the paint cup cap for the vent, as illustrated in U.S. Pat. No. 2,057,434. However, a vent of this type tends to clog with paint and is difficult to clean. Certain other solutions to the problem have provided large wetted surfaces which, again, are difficult or time consuming to clean. For example, the dripping problem has been reduced by providing a vent hole on one side of the cap covering the paint cup and providing a baffle space from the cap and closing the top of the paint cup, as illustrated in U.S. Pat. No. 3,401,842. A similar vent hole is placed in the baffle, but at a location spaced from the vent hole in the cap and located to an opposite side of the spray gun. Consequently, when the spray gun is tilted, only one of the two vent holes may be located below the surface of the paint. However, if the spray gun is tilted upside down, both vent holes will be located below the surface of the paint and eventually paint will drip from the spray gun. Or, if the spray gun is tilted first to the side of the baffle vent and then to the other side, paint trapped between the baffle and the cap may leak from the cap vent.

SUMMARY OF THE INVENTION

According to the present invention, a unitary check valve molded out of a resilient, solvent resistant material is positioned in or over a vent opening in a paint cup cap for a hand held spray gun. The check valve is molded as a single piece of material and in one embodiment, is provided with flanges for retaining it in the vent opening in the paint cup cap. The check valve has an end extending into the paint cup with a generally "duck bill" shape. Resilient sides of the check valve normally close a slot located on the interior side of the paint cup lid. As the air pressure within the paint cup begins to drop, the sides of the valve deflect to allow air to enter the paint cup. However, the sides of the check valve are normally urged together through the resiliency of the material so as to positively stop paint from leaking or dripping from the paint cup vent when the spray gun is inverted, regardless of the frequency or duration of inversion. Even though the paint cup may be inverted so that the check valve is located below the surface of the paint within the cup, the valve will continue to function by allowing air to enter the paint cup as paint is consumed. The check valve is designed to be easily cleaned and to be easily replaced at a low cost.

In a modified embodiment of the invention, the check valve is molded from resilient material to have generally "umbrella" shape. The check valve is generally in the shape of a concave dish having a stem projecting from the center of the concave side. The stem is inserted through an opening in the paint cup cap adjacent the vent opening. An annular shoulder formed on the stem retains the stem within the opening and also causes the stem to resiliently hold the cup over the vent opening. If desired, more than one vent openings may be formed in the paint cup cap to be covered simultaneously by a single check valve. As paint is consumed from the paint cup and a pressure drop appears across the check valve, the dish shaped portion of the check valve deflects to allow air to enter through the vent opening, past the check valve and into the paint cup.

Accordingly, it is an object of the invention to provide an improved non-clogging vent for a paint cup which will not leak when the paint cup is inverted.

Another object of the invention is to provide a vent for paint cups which allows air to pass into the paint cup while inhibiting the flow of paint from the paint cup through the vent, even when the paint cup is inverted.

Other objects and advantages of the invention will become apparent from the following detailed description, with reference being made to the accompanying drawings.

BRIEF DESCRIPTION OF THE DRAWINGS

FIG. 7 is a greatly enlarged perspective view of a modified check valve for use in a paint cup in accordance with the present invention;

FIG. 8 is an enlarged fragmentary side-elevational view of a paint cup for a suction feed hand held spray gun incorporating a check valve in accordance with a modified embodiment of the invention; and FIG. 9 is an enlarged fragmentary cross-sectional view, similar to FIG. 8, but showing a further modified embodiment of the invention.

DESCRIPTION OF THE PREFERRED EMBODIMENT

Figure 2:
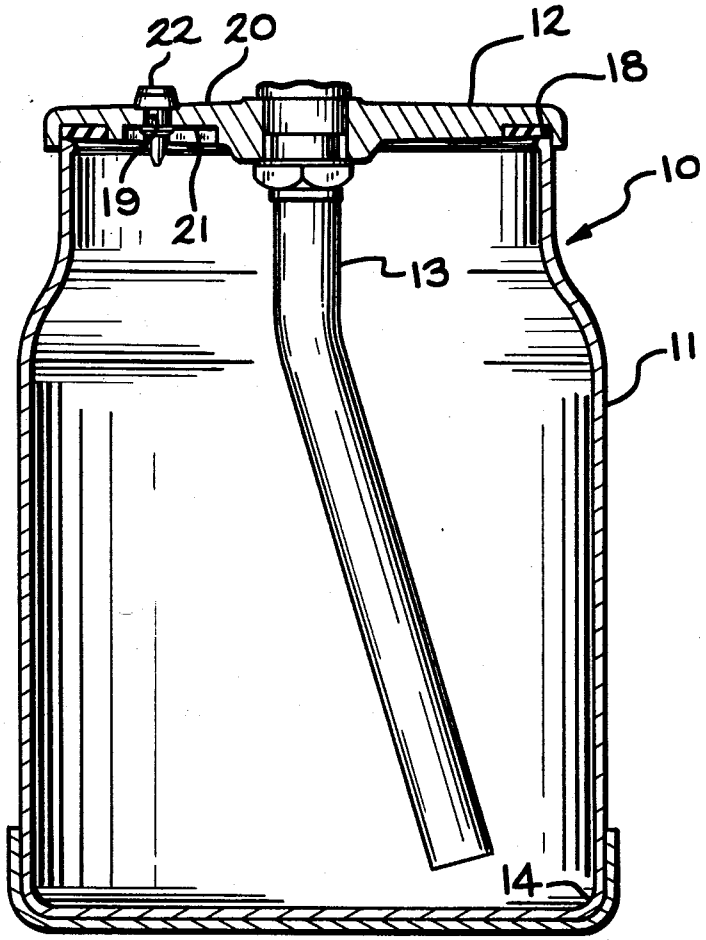
FIG. 2 is a cross-sectional view of a paint cup taken along line 2—2 of FIG. 1.
Figure 1:
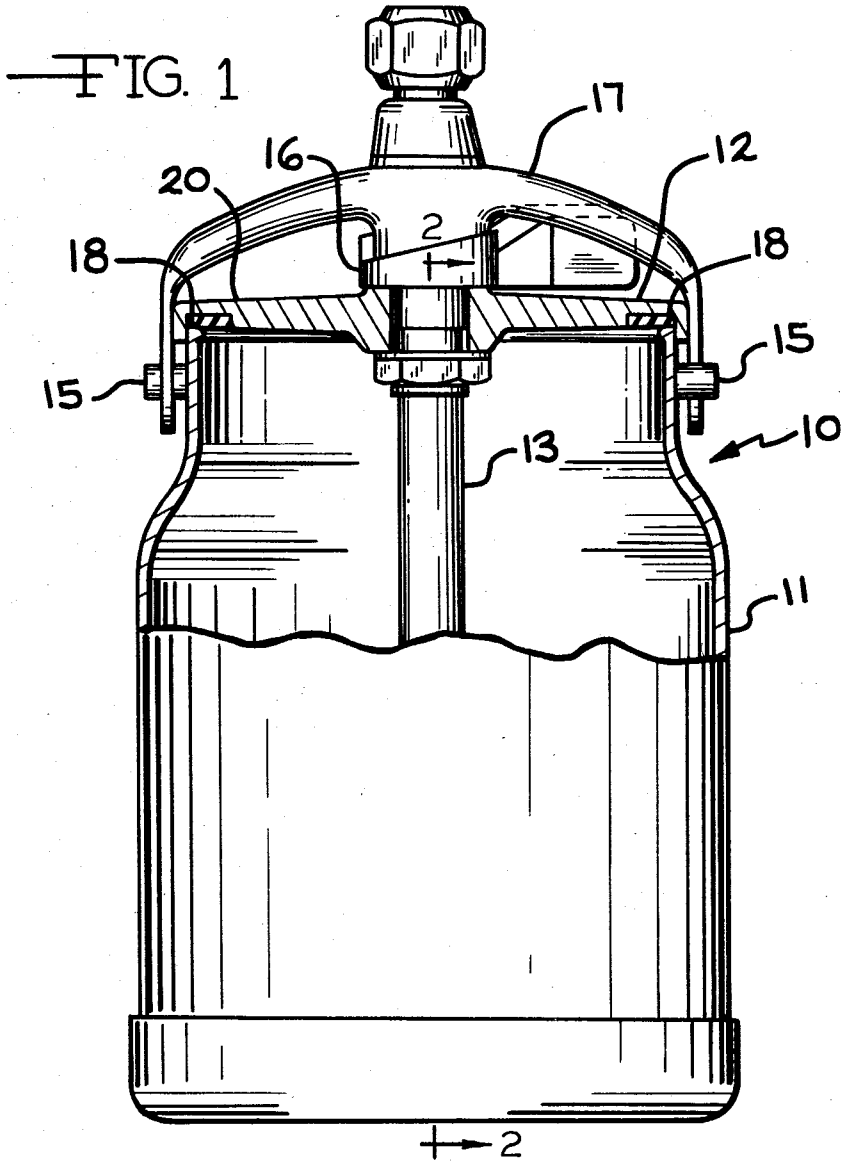
FIG. 1 is a fragmentary side elevational view of a paint cup for a suction feed hand held spray gun.
Figure 3:
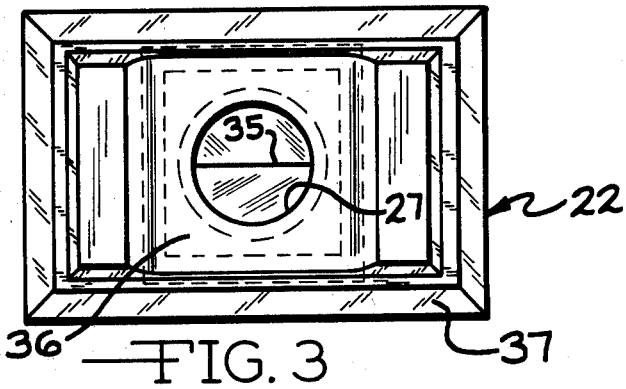
FIG. 3 is a top plan view of a check valve for a paint cup vent in accordance with the present invention.
Figure 4:
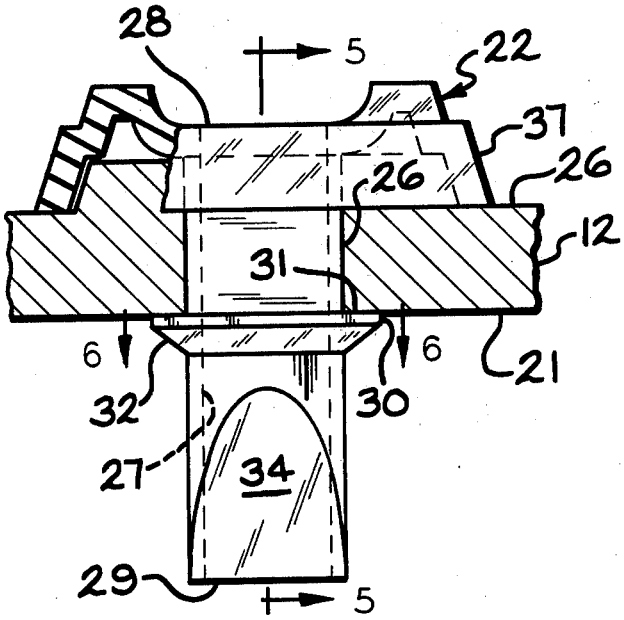
FIG. 4 is an enlarged side elevational view of the check valve of the present invention shown in a fragmentary portion of a paint cup cap.
Figure 5:
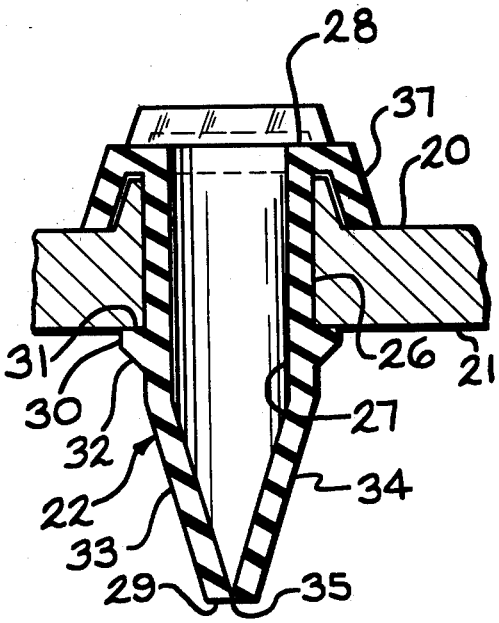
FIG. 5 is a cross-sectional view taken along line 5—5 of FIG. 4.

Turning now to the drawings and particularly to FIGS. 1 and 2, a fragmentary portion of a paint cup 10 is illustrated for use with a conventional air atomization, suction feed hand held spray gun (not shown). The paint cup 10 generally comprises a jar 11, a cap 12 and a suction feed fluid tube 13 which extends through the cap 12 to adjacent a lower front edge 14 of the jar 11. A pair of diametrically opposing pins 15 project outwardly from adjacent the top of the jar 11. The tube 13 extends through a beveled locknut 16 and a yolk 17. The yolk 17 engages the pins 15 and, when the locknut 16 is rotated, the cap 12 seals against an upper rim 18 on the jar 11.

A vent opening 19 is provided in the cap 12 to extend between an exterior cap surface 20 and an interior cap surface 21. In accordance with the present invention, a resilient unitary check valve insert 22 is positioned within the vent opening 19 to allow outside air to be drawn into the jar 11 as paint is consumed. In the event that the jar 11 is tilted so that the check valve insert 22 is below the liquid level, the check valve insert 22 inhibits a flow of paint through the vent opening 19. However, the check valve insert 22 remains effective to allow air to enter the paint jar 11 even though the insert 22 may be located below the liquid surface level. The check valve insert 22 is molded from a resilient, solvent resistant material such as a polysulfide. However, it will be apparent that other materials also will be suitable for use in molding the check valve insert 22.

Figure 6:
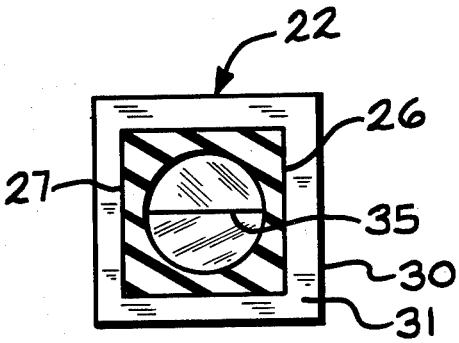
FIG. 6 is a cross-sectional view taken along line 6—6 of FIG. 4.

Turning now to FIGS. 3–6, details are shown for the molded check valve insert 22. The insert 22 generally comprises a tubular body 26 which is shaped to conform with the cap vent opening 19. For example, if the cap opening 19 is square in cross section, the body 26 will have a square exterior, as illustrated in FIG. 6. On the other hand, if the vent cap opening 19 is round, the body 26 will have a round exterior. An opening 27 extends downwardly from an upper end 28 above the exterior cap surface 20 to a lower end 29 spaced below the interior cap surface 21. A peripheral flange 30 extends around the insert body 26. The flange 30 has an upper sealing edge 31 which abuts the interior cap surface 21 and has a lower beveled edge 32 which facilitates positioning the check valve insert 22 within the vent opening 19. Below the peripheral flange 30, the insert 22 has two sides 33 and 34 which converge together at a slit 35 to form a "duck bill" portion of the insert. The sides 33 and 34 are resiliently urged together at the slit 35 to form a check valve. In the event that the air pressure within the paint cup 10 decreases slightly below the exterior pressure, the sides 33 and 34 resiliently deflect, opening the slit 35 to allow the pressures to substantially equalize. However, when there is not air flow through the check valve insert 22 into the paint cup 10, the sides 33 and 34 are resiliently urged together to close the slit 35. Consequently, paint cannot leak through the check valve insert 22 which closes the vent opening 19 when the paint cup 10 is tilted or inverted, regardless of the length of time in which the paint cup 10 is tilted or inverted.

The insert 22 has an upper surface 36 which extends generally outwardly from the upper body end 29. The upper surface 36 is spaced from the exterior cap surface 20 and terminates at a downwardly sloping skirt 37 which resiliently engages the exterior cap surface 20. The skirt 37 exerts a slight force on the exterior cap surface 20 to tend to force the insert 22 upwardly through the vent opening 19. This force is sufficient to maintain a fluid tight seal between the sealing edge 31 on the peripheral flange 30 and the interior cap surface 21.

Turning now to FIG. 7, a check valve insert 40 is illustrated in accordance with a modified embodiment of the invention. The check valve insert 40 is molded from a resilient, solvent resistant material and generally comprises an enlarged diameter concave dish portion 41 and a mounting stem 42 extending perpendicular to the center of the dish portion 41. A shoulder 43 is formed between the stem 42 and the center of the dish portion 41 and a second annular shoulder 44 is formed on the stem 42 spaced from the shoulder 43. The stem 42 has an end portion 45 spaced above the shoulder 44 which, preferably, has a slight taper to facilitate attaching the check valve insert 40 to a paint cup cap.

FIG. 8 illustrates the check valve insert 40 attached to a paint cup cap 46 which is sealed on a jar or cup 47 by means of a yolk 48 and a beveled locknut 49. The insert 40 is attached to the cap 46 by passing the stem end 45 upwardly through an opening 50 in the cap 46 and pulling on the end 45 until the shoulder 44 passes through the opening 50 and abuts an upper cap surface 51 and the shoulder 43 abuts a lower cap surface 52. When the insert 40 is so attached to the cap 46, a rim 53 around the outer periphery of the dish shaped portion 41 on the insert 40 is resiliently urged against the lower cap surface 52 to form a fluid tight seal between the rim 53 and the surface 52. The dish portion 41 covers one or more vent openings 54 extending through the cap 46. Since a seal is formed between the insert rim 53 and the cap 46, paint or other liquid within the jar 47 cannot leak through the vent opening 54 when the jar 47 is tilted during operation of an attached spray gun. However, as paint is consumed from the jar 47 and the air pressure within the jar 47 drops below the exterior air pressure, the resilient rim 53 on the insert 40 separates from the lower cap surface 52 to allow outside air to flow through the vent opening 54 and between the insert rim 53 and the cap 46 to substantially equalize the pressure within the jar 47 with the exterior air pressure. It should be noted that even when the jar 47 is tilted and the check valve insert 40 is located below the liquid surface level, the check valve insert 40 will continue to function to allow air to enter through the vent opening 54 into the jar 47 while preventing the liquid from flowing or dripping through the vent opening 54.

Referring to FIG. 9, the check valve insert 40 is illustrated mounted in a valve holder 58. The valve holder 58 is molded from a resilient material and is designed with an exterior annular groove 59 which snaps into and seals against an opening 60 in a paint cup cap 61. The valve holder 58 is provided with a handler or knob 62 which facilitates attaching and removing the valve holder 58 and the attached check valve insert 40 to the cap 61, without removing the cap 61 from the top of a paint jar 63. The valve holder 58 is provided with an opening 64 which receives the stem 42 of the check valve insert 40. The check valve insert 40 is retained on the valve holder 58 by means of the two spaced shoulders 43 and 44. When the check valve insert 40 is attached to the valve holder 58, the insert rim 53 seals against the valve holder 58 and the insert dish portion 41 covers one or more vent openings 65 which extend through the valve holder 58.

During operation of the spray gun, the check valve insert 40 functions in an identical manner for the two embodiments shown in FIGS. 8 and 9. However, in the event that the check valve insert 40 should require cleaning, it is necessary to remove the cap 46 from the jar 47 in the embodiment illustrated in FIG. 8 while the check valve insert may be cleaned or replaced by removing the valve holder 58 from the cap 61 without removing the cap 61 from the jar 63 in the embodiment illustrated in FIG. 9.

It should be noted that the check valve inserts 22 and 40 are of a simple molded construction. This results in a low cost and ease in cleaning or replacement. The check valve inserts 22 and 40 function both when the paint cup is in a normal upright position or when the paint cup is inverted and the check valve insert is located below the paint surface level. The check valve inserts 22 and 40 provide a positive stoppage of paint flow through the cap vent opening, regardless of the frequency or duration of inversion of the paint cup 10. Thus, the check valve inserts 22 and 40 are an improvement over prior art vent designs which are difficult to clean and may be ineffective in that they allow paint to escape if the paint cup is inverted too long or if they are not allowed to recover in an upright position for a sufficient time interval between periods of inversion. It also should be noted that many check valve designs are not suitable for venting a paint cup because they require too high of an operating force. The pressure drop across the check valve should be less than a one inch water column (0.036 psi) to avoid a noticable reduction in the paint feed rate.

It will be appreciated that various changes and modifications may be made in the check valve insert illustrated and described, without departing from the spirit and the scope of the following claims.

What I claim is:

1. An improved paint cup for a suction feed hand held spray gun comprising a paint jar, a removable cap closing said jar, said cap having interior and exterior surfaces, a vent opening extending through said cap, and a resilient unitary molded check valve means positioned in said vent opening for allowing exterior air to flow into said jar while inhibiting paint flow from said jar through said vent opening, said check valve means comprising a hollow body extending from above said exterior surface through said vent opening to below said interior surface, a peripheral flange extending about said body immediately below said interior surface, end means extending from said body and resiliently engaging said exterior surface for urging said flange against said interior surface to form a fluid seal at said interior surface, and resilient ducks bill ends means extending from said body below said interior surface for allowing air to be drawn into said jar while inhibiting paint flow from said jar through said vent opening.

2. An improved paint cup for a suction feed hand held spray gun comprising a paint jar, a removable cap closing said jar, said cap having interior and exterior surfaces, a vent opening extending through said cap, a resilient unitary molded check valve means positioned in said vent opening for allowing exterior air to flow into said jar while inhibiting paint flow from said jar through said vent opening, and means for retaining said check valve means in said vent opening.

3. An improved paint cup for a suction feed hand held spray gun, as set forth in claim 2, wherein said check valve means has a body extending through and conforming with walls of said vent opening, and wherein said retaining means includes a peripheral flange extending from said body and sealingly engaging said interior cap surface, and resilient means extending from said body and engaging said exterior cap surface.

4. An improved paint cup for a suction feed hand held spray gun comprising a paint jar, a removable cap closing said jar, said cap having interior and exterior surfaces and at least one vent opening extending through said cap between said interior and exterior surfaces, and a resilient molded check valve means closing said vent opening for allowing exterior air to flow into said jar while inhibiting paint flow from said jar through said vent opening, said check valve means including a resilient concave dish positioned against said interior cap surface to extend over said vent opening and means urging said dish into sealing contact with said interior cap surface whereby said dish prevents paint in said jar from flowing through said vent opening.

5. An improved paint cup for a suction feed hand held spray gun, as set forth in claim 4, wherein said means urging said dish into sealing contact with said interior cup surface includes an integral center stem projecting from the interior of said dish, said center stem extending through a second opening in said cap adjacent said vent opening, and means for retaining said center stem in said second opening to hold said dish resiliently against said interior cap surface.

6. An improved paint cup for a suction feed hand held spray gun, as set forth in claim 5, wherein said retaining means comprises an annular shoulder integral formed on said stem, said shoulder resiliently engaging said exterior cap surface.

7. An improved paint cup for a suction feed hand held spray gun, a set forth in claims 4, 5 or 6, and wherein said cap defines an enlarged diameter opening, wherein said cap includes a valve holder releasably mounted to close said enlarged diameter opening, said valve holder defining said vent opening, and wherein said check valve means is mounted on said valve holder.

* * * * *